US006857159B1

(12) United States Patent
Strine

(10) Patent No.: US 6,857,159 B1
(45) Date of Patent: Feb. 22, 2005

(54) RENEWABLE SPONGE

(76) Inventor: Tracy Strine, 207-03 Estates Dr., Bayside, NY (US) 11360

( * ) Notice: Subject to any disclaimer, the term of this patent is extended or adjusted under 35 U.S.C. 154(b) by 0 days.

(21) Appl. No.: 10/675,897

(22) Filed: Sep. 30, 2003

(51) Int. Cl.[7] ..... A47L 13/12; A47L 13/16
(52) U.S. Cl. ..... 15/118; 15/229.11; 15/244.4
(58) Field of Search ..... 15/118, 223, 229.11, 15/244.3, 244.4

(56) References Cited

U.S. PATENT DOCUMENTS

| | | | | | |
|---|---|---|---|---|---|
| 1,841,208 | A | * | 1/1932 | Retz | 451/491 |
| 3,021,649 | A | * | 2/1962 | Robbins | 451/534 |
| 3,080,688 | A | * | 3/1963 | Politzer | 15/118 |
| 3,703,739 | A | * | 11/1972 | Young et al. | 15/230.17 |
| 4,866,806 | A | | 9/1989 | Bedford | 15/104.94 |
| 5,095,574 | A | * | 3/1992 | Khanzadian | 15/118 |
| 5,507,906 | A | | 4/1996 | Woods et al. | 156/271 |
| 5,640,737 | A | | 6/1997 | Boggs | 15/118 |
| 5,836,034 | A | | 11/1998 | Galvan Garza | 15/118 |
| 6,485,822 | B1 | | 11/2002 | Osiecki et al. | 428/316.6 |
| 2003/0027496 | A1 | | 2/2003 | Back et al. | 451/36 |

* cited by examiner

*Primary Examiner*—Mark Spisich
(74) *Attorney, Agent, or Firm*—Richard L Miller, P.L., Registered Patent Attorney

(57) ABSTRACT

A renewable sponge. A body includes a non-abrasive layer and an abrasive layer that overlies, and is attached to, the non-abrasive layer. Each of the non-abrasive layer and the abrasive layer include a plurality of peel-off layers that are substantially separated from each other by strategically positioned slits so as to allow each of the plurality of peel-off layers to be peeled off when exhausted and expose a next peel-off layer so as to renew the renewable sponge. The strategically positioned slits extend between adjacent ones of the plurality of peel-off layers completely across the body, from one side of the body to the other side of the body. The strategically positioned slits that are between adjacent layers of the plurality of peel-off layers are separated from each other by non-slitted portions of the body.

7 Claims, 1 Drawing Sheet

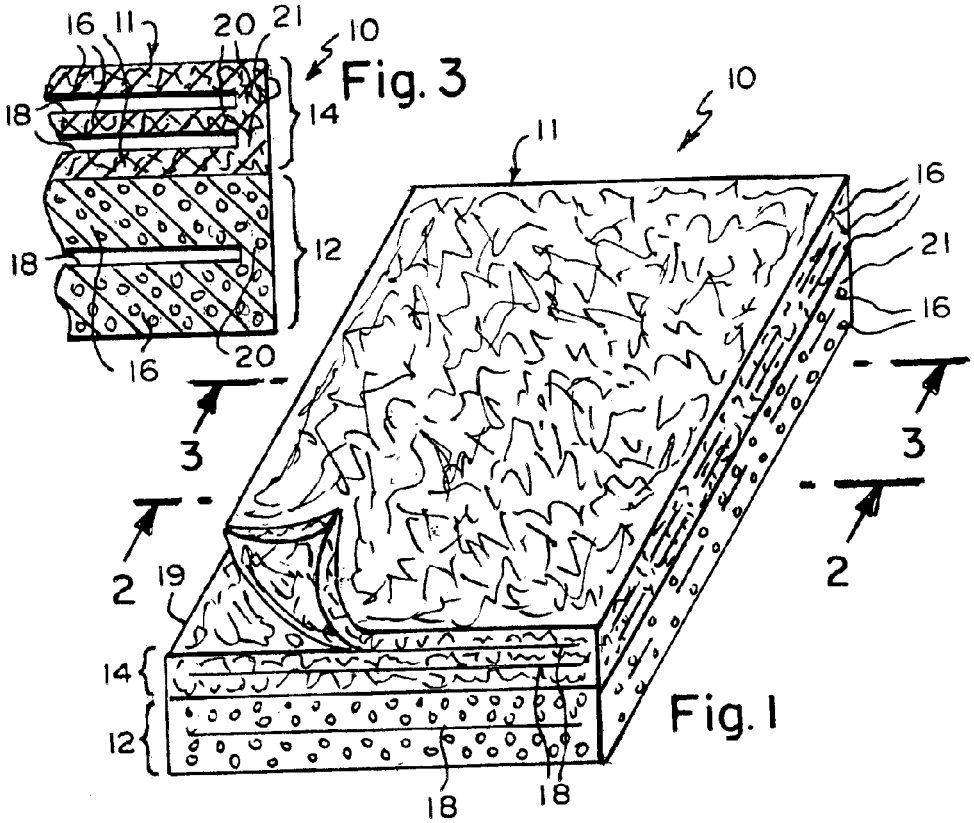
Fig. 3
Fig. 1
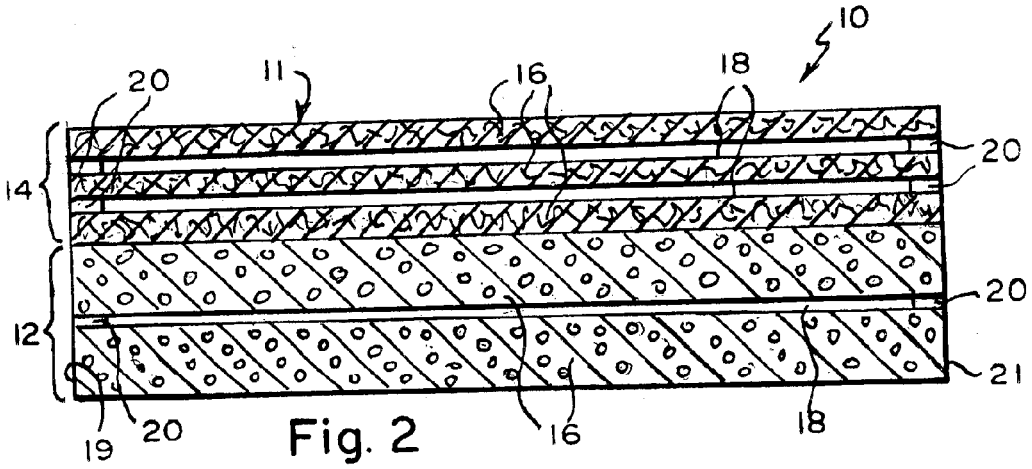
Fig. 2

RENEWABLE SPONGE

BACKGROUND OF THE INVENTION

1. Field of the Invention

The present invention relates to a sponge. More particularly, the present invention relates to a renewable sponge.

2. Description of the Prior Art

Numerous innovations for sponges have been provided in the prior art that will be described. Even though these innovations may be suitable for the specific individual purposes to which they address, however, they differ from the present invention.

A FIRST EXAMPLE, U.S. Pat. No. 4,866,806 to Bedford teaches a multilayered foam scrub sponge for cleanup prior to a surgical procedure. One layer serves to impart a degree of rigidity to the structure, another layer retains an antiseptic solution, while a third layer acts as a scrubbing surface. The sponge is shaped to fall easily to the human hand. A toothed profile on the edges presents a rough surface for an augmented scrubbing capability. A removable serrated insert accommodated in the center of the sponge enable insertion of the fingers to cleanse and disinfect the cuticle areas. Removal of the insert allows access to a fingernail pick stored thereunder. The sponge is stored in a solution-impregnated state within a sealed package ready for immediate use.

A SECOND EXAMPLE, U.S. Pat. No. 5,507,906 to Woods et al. teaches a method for manufacturing a laminated pad in a cost-efficient manner. In one embodiment, the method comprises the steps of applying strips of adhesive to a first substrate and mounting the first substrate to a second substrate. Next, adhesive is applied to the entire width of a third substrate which is in turn mounted to the laminated first and second substrates to create a laminated sheet. The laminated sheet can be slit and then die cut into individual laminated pads. The pads which result from this process have a base pad, an intermediate layer which is adhered to the base pad and a top layer in which only a portion of the top layer is mounted to the intermediate layer.

A THIRD EXAMPLE, U.S. Pat. No. 5,640,737 to Boggs teaches a multi-component sponge that has a central or main foam layer of reticulated single cell polyurethane flexible foam and an outer foam layers adhered to each of its two substantially parallel sides so that liquid can flow between the main foam layer and the two outer foam layers. Each of the two outer foam layers is preferably polyurethane flexible foam having a reticulated double cell structure although each could be a reticulated single cell structure having a porosity in the range of 3–110 pores per inch. The main foam layer preferably has a porosity in the range of 3–30 pores per inch. Each of the two outer foam layers is softer than the main foam layer.

A FOURTH EXAMPLE, U.S. Pat. No. 5,836,034 to Galvan Garza teaches a soft/abrasive sponge, and more specifically to a sponge of the type that is used for cleaning any class of articles such as dishes, bathrooms, tiles etc., which combines in one body of any geometric shape one section of a soft surface; on the opposite section an extremely abrasive surface and on its peripheral sides a plurality of protecting salients which make up the rounded tips which provide the possibility to scrub places which only are penetrated with great difficulty by any other type of sponge when cleaning those areas.

A FIFTH EXAMPLE, U.S. Pat. No. 6,485,822 B1 to Osiecki et al. teaches a multi-layer combination sponge that includes a scrubbing layer and a cleaning layer that are each laminated to an intermediate layer. The intermediate layer is more compressible than the cleaning layer and the scrubbing layer, and a groove is formed around a perimeter of the sponge between the cleaning layer and the scrubbing layer. The layers are preferably coextensive, forming a nose portion at the front of the combination sponge and having rounded corners at the rear of the combination sponge. The cleaning and intermediate layers each have an approximately equal thickness, and the scrubbing layer has a thickness less than one-half as thick as either the cleaning layer or the intermediate layer.

A SIXTH EXAMPLE, U.S. Patent Application Publication No. 2003/0027496 A1 to Black et al. teaches a method and apparatus for cleaning and shaping a probe tip using a multi-layer adhesive and abrasive pad. The multi-layer adhesive and abrasive pad is constructed on the surface of a support structure, such as a silicon wafer, and is made of an adhesive in contact with abrasive particles. Adhesive is applied in layers with abrasive particles in-between each layer of adhesive. Abrasive particles may vary in size and material from layer to layer to achieve cleaning, shaping and polishing objectives.

It is apparent that numerous innovations for sponges have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a renewable sponge that avoids the disadvantages of the prior art.

ANOTHER OBJECT of the present invention is to provide a renewable sponge that is simple to use.

BRIEFLY STATED, STILL ANOTHER OBJECT of the present invention is to provide a renewable sponge. A body includes a non-abrasive layer and an abrasive layer that overlies, and is attached to, the non-abrasive layer. Each of the non-abrasive layer and the abrasive layer include a plurality of peel-off layers that are substantially separated from each other by strategically positioned slits so as to allow each of the plurality of peel-off layers to be peeled off when exhausted and expose a next peel-off layer so as to renew the renewable sponge. The strategically positioned slits extend between adjacent ones of the plurality of peel-off layers completely across the body, from one side of the body to the other side of the body. The strategically positioned slits that are between adjacent layers of the plurality of peel-off layers are separated from each other by non-slitted portions of the body.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of the present invention;

FIG. 2 is an enlarged diagrammatic cross sectional view taken along line 2—2 in FIG. 1; and FIG. 3 is an enlarged diagrammatic partial cross sectional view taken along line 3—3 in FIG. 1.

LIST OF REFERENCE NUMERALS UTILIZED IN THE DRAWING

10 renewable sponge of present invention
11 body
12 non-abrasive layer of body 11
14 abrasive layer of body 11
16 plurality of peel-off layers of each of non-abrasive layer 12 of body 11 and abrasive layer 14 of body 11
18 strategically positioned slits in body 11
19 one side of body 11
20 non-slitted portions of body 11
21 other side of body 11

DETAILED DESCRIPTION OF THE PREFERRED EMBODIMENT

Referring now to the figures, in which like numerals indicate like parts, and particularly to FIGS. 1–3, the renewable sponge of the present invention is shown generally at 10.

The renewable sponge 10 comprises a body 11. The body 11 comprises a non-abrasive layer 12 and an abrasive layer 14. The non-abrasive layer 12 of the body 11 overlies, and is attached to, the abrasive layer 14 of the body 11.

Each of the non-abrasive layer 12 of the body 11 and the abrasive layer 14 of the body 11 comprises a plurality of peel-off layers 16. The plurality of peel-off layers 16 of the body 11 are substantially separated from each other so as to allow each of the peel-off layers 16 of the body 11 to be peeled off when exhausted and expose a next peel-off layer 16 of the body 11 so as to renew the renewable sponge 10.

The plurality of peel-off layers 16 of the body 11 are substantially separated from each other by strategically positioned slits 18. The strategically positioned slits 18 in the body 11 extend between adjacent ones of the plurality of peel-off layers 16 of the body 11.

The strategically positioned slits 18 in the body 11 extend completely across the body 11, from one side 19 of the body 11 to the other side 21 of the body 11.

The strategically positioned slits 18 in the body 11 that are between adjacent layers of the plurality of peel-off layers 16 of the body 11 are separated from each other by non-slitted portions 20 of the body 11, and since the strategically positioned slits 18 in the body 11 extend completely across the body 11, from the one side 19 of the body 11 to the other side 21 of the body 11, the non-slitted portions 20 of the body 11 are visible from the one side 19 of the body 11 and the other side 21 of the body 11.

It will be understood that each of the elements described above, or two or more together, may also find a useful application in other types of constructions differing from the types described above.

While the invention has been illustrated and described as embodied in a renewable sponge, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A renewable sponge, comprising:

a body;

wherein said body comprises a non-abrasive layer;

wherein said body comprises an abrasive layer;

wherein said non-abrasive layer of said body overlies said abrasive layer of said body;

wherein said non-abrasive layer of said body is attached to said abrasive layer of said body; and wherein each of said non-abrasive layer of said body and said abrasive layer of said body comprises a plurality of peel-off layers.

2. The sponge as defined in claim 1, wherein said plurality of peel-off layers of said body are substantially separated from each other so as to allow each of said plurality of peel-off layers of said body to be peeled off when exhausted and expose a next peel-off layer of said body so as to renew said renewable sponge.

3. The sponge as defined in claim 1, wherein said plurality of peel-off layers of said body are substantially separated from each other by strategically positioned slits.

4. The sponge as defined in claim 3, wherein said strategically positioned slits in said body extend between adjacent ones of said plurality of peel-off layers of said body.

5. The sponge as defined in claim 3, wherein said strategically positioned slits in said body extend completely across said body, from one side of said body to the other side of said body.

6. The sponge as defined in claim 5, wherein said strategically positioned slits in said body that are between adjacent layers of said plurality of peel-off layers of said body are separated from each other by non-slitted portions of said body.

7. The sponge as defined in claim 6, wherein said non-slitted portions of said body are visible from said one side of said body and said other side of said body since said strategically positioned slits in said body extend completely across said body, from said one side of said body to said other side of said body.

* * * * *